US005915475A

United States Patent [19]

Wells et al.

[11] Patent Number: 5,915,475

[45] Date of Patent: Jun. 29, 1999

[54] DOWN HOLE WELL PUMPING APPARATUS AND METHOD

[76] Inventors: Edward A. Wells, 14862 Cabo de Bara, Corpus Christi, Tex. 78418; Paul S. Barter, Jr., P.O. Box 912, Georgewest, Tex. 78022

[21] Appl. No.: 08/898,325

[22] Filed: Jul. 22, 1997

[51] Int. Cl.[6] ..... E21B 43/00; E21B 27/00

[52] U.S. Cl. ..... 166/68.5; 166/68; 166/105; 166/108; 166/109; 417/56; 417/904

[58] Field of Search ..... 166/68, 68.5, 105, 166/108, 109, 369; 417/358, 205, 56, 555.2, 554, 904

[56] References Cited

U.S. PATENT DOCUMENTS 2,921,531 1/1960 Brennan .
2,931,304 4/1960 Massey .
3,304,871 2/1967 Scroggins .
3,517,741 6/1970 Roeder .
3,653,786 4/1972 McArthur .
3,703,926 11/1972 Roeder .
4,268,227 5/1981 Roeder .
4,745,969 5/1988 Henderson ..... 166/68.5

*Primary Examiner*—Tamara Graysay
*Assistant Examiner*—Sunil Singh
*Attorney, Agent, or Firm*—G. Turner Moller

[57] ABSTRACT

A method and apparatus for pumping formation liquids provides a reciprocating down hole pump on the end of a coiled tubing string. In one embodiment, one fluid flow path is provided through the inside of the coiled tubing and another flow path is provided in an annulus between the coiled tubing and a, production string. In one embodiment, pressure delivered down the annulus to the pump moves a piston in a direction to move formation liquids upwardly to the surface. When pressure in the annulus is reduced, the hydrostatic weight of the pumped liquid moves the piston in a retracting direction to prepare for the next stroke. In other embodiments, the piston is moved downwardly, in retracting direction, by fluid pressure applied from the surface.

21 Claims, 4 Drawing Sheets

DOWN HOLE WELL PUMPING APPARATUS AND METHOD

This invention relates to a method and apparatus for pumping formation liquids from a well and more particularly to pumping formation liquids from a well using a hydraulically operated pump.

BACKGROUND OF THE INVENTION

There are many different techniques for artificially lifting formation liquids from hydrocarbon wells. Reciprocating sucker rod pumps are the most commonly used in the oil field because they are the most cost effective, all things considered, over a wide variety of applications. Other types of artificial lift include electrically driven down hole pumps, hydraulic pumps, rotating rod pumps, free pistons and several varieties of gas lift. These alternate types of artificial lift are more cost effective than sucker rod pumps in the niches or applications where they have become popular.

One of the developments that has evolved over the last thirty years are so-called tubingless completions in which a string of tubing, usually 2⅞" O.D., is cemented in the well bore and then used as the production string. Tubingless completions are never adopted where pumping a well is initially considered likely because sucker rod pumps have proved to be only slightly less than a disaster when used in a 2⅞" tubingiess completions. Artificial lift in a 2⅞" tubingless completion is almost universally limited to gas lift or free pistons. Thus, tubingless completions are typically used in shallow to moderately deep wells that are believed, at the time a completion decision is made, to produce all or mostly gas, i.e. no more liquid than can be produced along with the gas.

Gas wells reach their economic limit for a variety of reasons. A very common reason is the gas production declines to a point where the formation liquids are not readily moved up the production string to the surface. The terminology is that these wells load up and die. The reason is an accumulation of liquid in the well which causes gas production to stop. Years ago, gas wells were plugged much quicker than today because it was not economic to artificially lift small quantities of liquid from a gas well. At relatively high gas prices, it makes sense to keep old gas wells on production. It has gradually been realized that gas wells have a life cycle that includes an old age segment where a variety of techniques are used to keep liquids flowing upwardly in the well and thereby prevent the well from loading up and dying.

There are many techniques for keeping old gas wells flowing and the appropriate one depends on where the well is in its life cycle. For example, the first technique is to drop soap sticks into the well. The soap sticks and some agitation cause the liquids to foam. The well is then turned to the atmosphere and a great deal of foamed liquid is discharged from the well. Later in its life cycle, when soaping the well has become much less effective, a string of 1" or 1½" tubing is run inside the production string. The idea is that the upward velocity in the small tubing string is much higher which keeps the liquid moving upwardly in the well to the surface. A rule of thumb is that wells producing enough gas to have an upward velocity in excess of 10'/second will stay unloaded. Wells where the upward velocity is less than 5'/second will always load up and die.

At some stage in the life of a gas well, these techniques no longer work and the only approach left to keep the well on production is to artificially lift the liquid with a pump of some description. The logical and time tested technique is to pump the accumulated liquid up the tubing string with a sucker rod pump and allow produced gas to flow up the annulus between the tubing string and the casing string. This is normally not practical in a 2⅞" tubingless completion unless one tries to use hollow rods and pump up the rods, which normally doesn't work very well or very long. Even then, it is not long before the rods cut a hole in the 2⅞" string and the well is lost. In addition, sucker rod pumps require a large initial capital outlay and either require electrical service or elaborate equipment to restart the engine.

Hydraulically powered pumps are well known in the art as shown in U.S. Pat. Nos. 2,921,531; 2,931,304; 3,304,871; 3,517,741; 3,653,786; 3,703,926 and 4,268,277.

SUMMARY OF THE INVENTION

In this invention, a hydraulically operated piston pump is run on the end of a length of coiled tubing and landed near the bottom of the well. A first fluid path is provided for delivering pressurized liquid to the piston to drive the piston in a pumping direction. A second fluid path is provided for transmitting the pumped formation liquid to the surface. One of these paths is through the coiled tubing to which the piston pump is connected. The piston is retracted by reducing the pressure can the power liquid and allowing the hydrostatic weight of the pumped fluid to drive the piston downwardly.

In one embodiment of this invention, the coiled tubing string is run inside the previous production string so one of the fluid paths is inside the coiled tubing and another fluid path is in the annulus between the coiled tubing and the previous production string. In another embodiment of this invention, concentric coiled tubing strings are run into the well with one of the fluid paths being inside the coiled tubing and another of the fluid path being in the annulus between the coiled tubing strings. In another embodiment of this invention, parallel strings of coiled tubing are run into the well with the second fluid path being the second coiled tubing string.

The hydraulic pump of this invention is of unusual configuration and differs only slightly between different applications. An outer barrel and inner mandrel are provided. A pump sleeve is positioned around the inner mandrel and carries an annular piston at one end sealed against the inside of the outer barrel. A seal. assembly seals between the inside of the pump sleeve and the outside of the mandrel. The piston works in a piston chamber provided between the outer barrel and mandrel. The piston is reciprocated by alternately increasing and decreasing the pressure acting on the piston so the pump sleeve reciprocates. Extension of the pump sleeve basically lowers a check valve into an accumulation of formation liquids. Retraction of the pump sleeve basically raises the liquid column past a second check valve which prevents reverse or back flow.

It is an object of this invention to provide an improved method and apparatus for pumping formation liquids from a well.

Another object of this invention is to provide a method and apparatus for pumping formation liquids from a well using one or more coiled tubing strings.

Another object of this invention is to provide an improved down hole hydraulic pump for lifting formation liquids from wells.

These and other objects of this invention will become more fully apparent as this description proceeds, reference being made to the accompanying drawings and appended claims.

DETAILED DESCRIPTION

Figure 1:
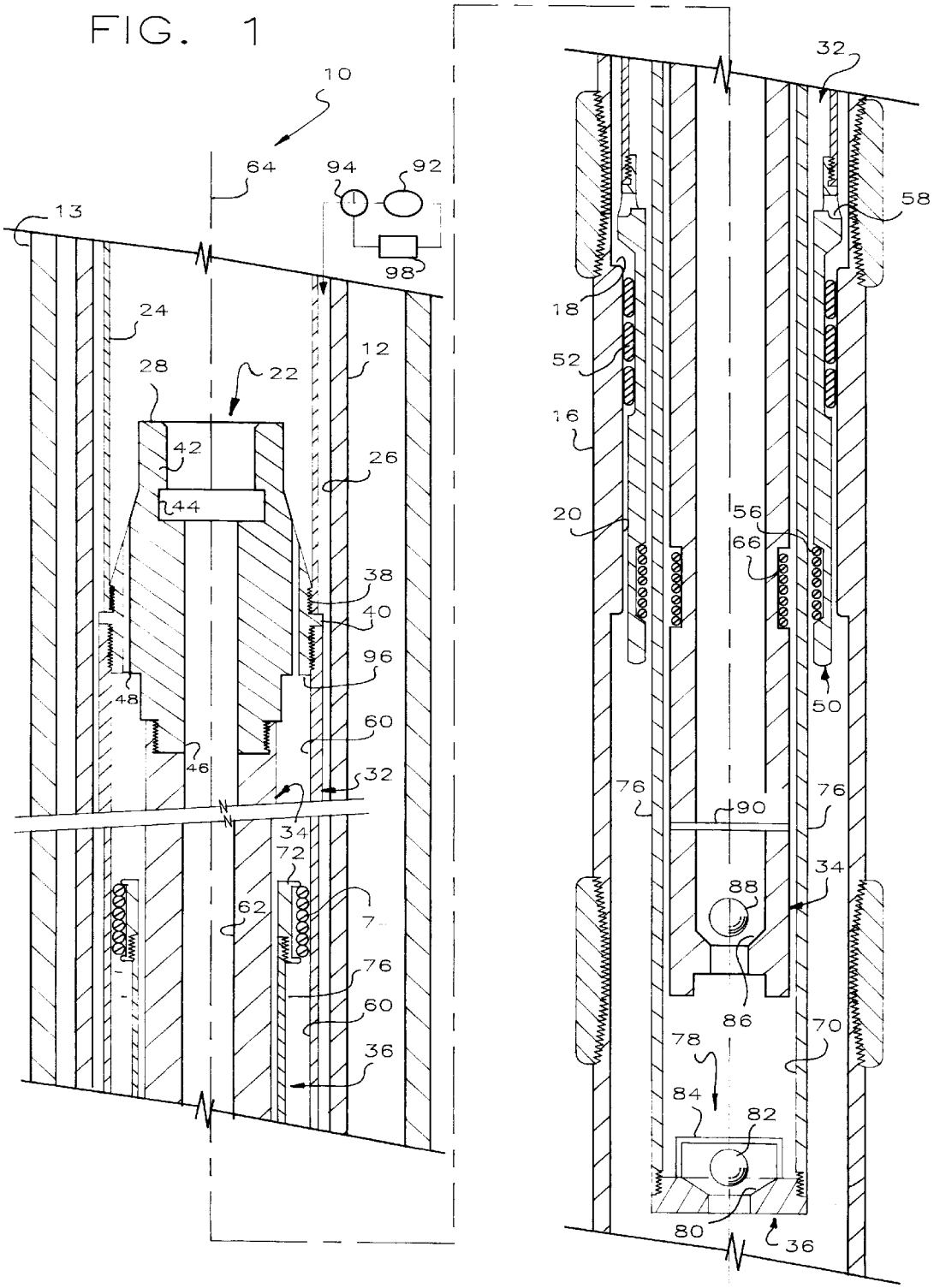
FIG. 1 is a longitudinal cross-sectional view of one embodiment of a down hole pump of this invention, illustrating the pump near the end of its upstroke.

Referring to FIG. 1, a hydrocarbon well 10 comprises a production string 12 extending into the earth in communication with a subterranean hydrocarbon bearing formation. The production string 12 is typically a conventional tubing string made up of joints of tubing that are threaded together. Typically, the tubing string 12 is inside a casing string 13 cemented in the earth. When pumping an oil well, the tubing string 12 is normally set on a packer (not shown) sealing the annulus between the production string 12 and the casing string 13. When pumping a gas well, the tubing string 12 is normally run into the casing 13 without a packer to provide a path for gas flow up the annulus between the casing 13 and tubing 12. Conventional tubing strings 12 normally include a seating nipple 16 having a shoulder stop 18 above a smooth sealing surface 20. The tubing string 12 and seating nipple 16 will be recognized by those skilled in the art.

In a typical application of this invention, the well 10 is a gas well that produces some formation liquid. In an earlier stage of the productive life of the well 10, there is sufficient gas being produced to deliver the formation liquids to the surface. As the quantity of produced gas declines and/or the quantity of formation liquids increases, there comes a time when the well 10 is prone to load up and die. In order to keep the well 10 producing, a down hole pump 22 of this invention is run into the well on the end of a coiled tubing string 24 and manipulated to pump formation liquids to the surface. As will be more fully apparent hereinafter, formation liquids are pumped upwardly through a first fluid path inside the coiled tubing 24 in response to pumping a power fluid downwardly through the annulus 26 between the coiled tubing 24 and the tubing string 12.

The pump 22 comprises, as major components, an end cap or fitting 28 providing connection to the coiled tubing string 24, a stationary outer barrel or housing 32 sealed against the seating nipple 16, a stationary inner mandrel 34 and a reciprocating pump sleeve 36. The end cap 28 connects in any convenient manner to the coiled tubing string 24, as by deforming the coiled tubing string 24 in grooves 38 above a shoulder 40. In the alternative, the coiled tubing string 24 may be welded to the shoulder 40. The end cap 28 provides an enlarged upper central passage 42, a latching recess 44, a smaller central passage 46 and at least two parallel passages or bypass ports 48 for purposes more fully apparent hereinafter.

The barrel 32 is essentially a long tube having its upper end threaded or otherwise connected to the end cap 28. A sealing section 50 on the lower end of the barrel 32 seals against the seating nipple surface 20 and seals against the pump sleeve 36. The sealing section 50 accordingly includes a series of resilient seals 52 compressed between the seating nipple 16 and the body of the sealing section 50. The sealing section 50 also includes a seal assembly 56 comprising a plurality of seals bearing against the exterior of the reciprocating pump sleeve 36. The barrel 32 also includes a series of passages or ports 58, preferably located on the sealing section 50, allowing fluid flow between the annulus 26 and a piston chamber 60 provided between the outer barrel 32 and the inner mandrel 34.

The mandrel 34 is threaded or otherwise attached to the end cap 28 and includes a central passage 62 coaxial with an axis 64 of the pump 22. The mandrel 34 also includes a seal assembly 66 comprising a plurality of seals bearing against the interior of the reciprocating pump sleeve 36.

The pump sleeve 36 fits between the outer barrel 32 and the mandrel 34 in the piston chamber 60. A pump chamber 70 is provided between the pump sleeve 36 and the mandrel 34, below the seal assembly 56. The pump sleeve 36 includes an annular piston 72 in the piston chamber 60 and having an assembly 74 sealing against the interior of the outer barrel 32, a tube 76 receiving the mandrel 34 and a check valve assembly 78 allowing liquid entry into the bottom of the tube 76 and preventing downward or back flow from the tube 76.

The check valve assembly 78 includes a first valve seat 80 on the pump sleeve 36 cooperating with a first ball check 82 and a cage 84 retaining the ball check 82 adjacent the seat 80. The check valve assembly 78 also includes a second valve seat 86 inside the mandrel 34 cooperating with a second ball check 88 and a pin 90 captivating the ball check 88. When the pump sleeve 36 is moving downwardly, the ball check 82 opens to allow formation fluids to enter the pump chamber 70. The ball check 88 closes when the pump sleeve 36 is moving downwardly because of the hydrostatic weight of liquid in the coiled tubing 24. When the pump sleeve 36 moves upwardly, the ball check 82 closes and the ball check 88 opens, causing formation fluid to be lifted toward the surface of the well 10. As the pump sleeve 36 approaches its uppermost position, the distance between the lower and upper ball checks 82, 88 is very small so that gas locking is very rare.

It will be seen that the mandrel seal 66 engages the inside of the pump sleeve 34 while the barrel seal 56 engages thus outside of the pump sleeve 34. It is much preferred that the seals 56, 66 be in a common horizontal plane, i.e. immediately opposite one another, so any force exerted by the seal 56 on the tube 76 is opposed by a force exerted by the seal 66. This means the tube 76 does not have to be extraordinarily robust.

Operation of the pump 22 should now be apparent. Any gas and liquid produced by the hydrocarbon formation separates in the well bore with the gas flowing up the annulus between the tubing string 12 and the casing 13. Assuming the pump sleeve 36 is fully extended, i.e. is its most downward position, formation liquids are free to flow past the lower ball check 82 into the pump chamber 70. In response to a timing signal, a liquid in the annulus 26 is pressured up from the surface of the earth in any suitable manner, as by actuating a pump 92 and manipulating a three-way valve 94. The pump 92 is typically a liquid pump although gas pressure acting above a liquid in the annulus 26 is equally workable. For purposes more fully apparent hereinafter, the liquid in the annulus 26 is chosen to be of lower specific gravity than the pumped liquid from the formation. Liquid from the annulus 26 flows through the passages or ports 58 into the piston chamber 60 below the piston 72. As pressure in the chamber 62 below the piston 72 increases, it ultimately overcomes the hydrostatic pressure of the formation liquids inside the coiled tubing 24 that act on the top of the piston 72 through the bypass ports 48 so the piston 72 moves upwardly toward the end cap 28. This decreases the size of the pump chamber 70 and formation liquid in the chamber 70 moves upwardly past the upper ball check 88.

As the piston 72 approaches its upper limit of travel, as by seating against a stop 96 on the end cap 28, the three way valve 94 is manipulated to connect the annulus 26 with a sump or reservoir 98. This reduces the pressure in the piston chamber 60 below the piston 72. The piston 72 then moves downwardly because the formation liquid in the coiled tubing string 24 is more dense than the liquid in the annulus 26 and the hydrostatic pressure of the formation liquid communicates with the top of the piston 72 through the bypass openings 48. The upper ball check 88 closes so any liquid in the coiled tubing 24 and mandrel 34 does not back flow into the pump chamber 70. Some of the liquid pumped into the annulus 26 returns through the three way valve 94 to the sump 98. Thus, the piston 72 is moved in its up or pumping stroke by pressuring up the annulus 26 and is moved down or in its retracting stroke by the hydrostatic weight of pumped liquid in the coiled tubing 24.

In effect, the pump sleeve 36 is dipped into an accumulation of liquid in the well 10 so liquid flows past the check valve assembly 78 into the pump 22. The pump sleeve 36 is then raised so the liquid column is raised above the upper ball check 88.

Repeating this process causes formation liquid to be pumped to the surface. In another view, the pump chamber 70 is of maximum size when the pump sleeve 36 is down and the pump chamber 70 is of minimum size when the pump sleeve 36 is up. The amount of liquid pumped during each pump stroke is equal to the difference between the maximum and minimum sizes of the pump chamber 70.

An important feature of this invention is the pump 22 is run on the end of the coiled tubing string 24. Thus, the pump 22 may be installed and retrieved with a coiled tubing unit. It will be seen that one liquid flow path is inside the coiled tubing 24 and another liquid path is in the annulus 26. It will be apparent that the liquid paths can be reversed, i.e. the pumped fluid can be made to travel up the annulus and the power fluid may be made to travel inside the coiled tubing simply by rerouting the passages 48, 58 to make them communicate with the lower and upper surfaces of the piston 72 respectively.

It might be thought difficult to find a liquid of lower specific gravity, compared to the pumped formation liquid, for use in the annulus 26. This is normally not the case. Almost all pumped wells, including those gas wells near the end of their economic life, produce some salt water. Thus, even if the liquid being pumped is high gravity condensate, the addition of salt water to the pumped liquid makes the formation liquid more dense than the liquid used in the annulus 26, which can be high gravity condensate, free of water.

Figure 2:
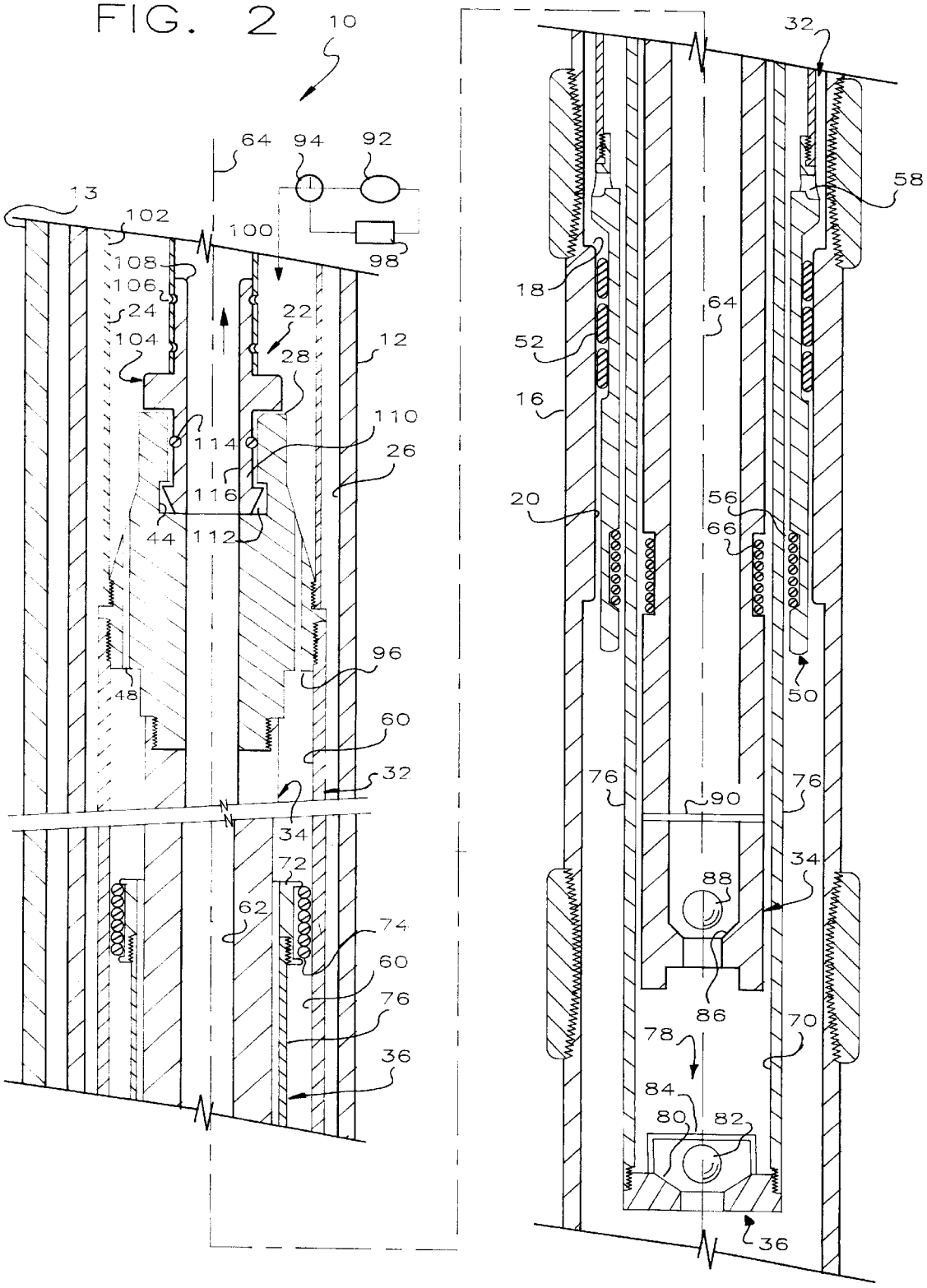
FIG. 2 is a longitudinal cross-sectional view of another embodiment of a down hole pump of this invention, illustrating a second coiled tubing string providing another fluid flow path between the pump and the surface.

Referring to FIG. 2, the pump 22 is illustrated with a second coiled tubing string 100 used to provide another fluid path to the surface. Thus, in the embodiment of FIG. 2, there is a first fluid path in the annulus 26, a second fluid path in the annulus 102 between the coiled tubing string 24 and the coiled tubing string 100, and a third fluid path inside the coiled tubing string 100.

The coiled tubing string 100 is attached to the end cap 28 by a fitting 104 connected to the end of the coiled tubing 100 in any suitable manner, such as by deforming the wall of the coiled tubing 100 in grooves 106 provided by an upstanding pin 108 of the fitting 104. In the alternative, it is conventional to weld the end of coiled tubing to down hole tools and a welded connection between the coiled tubing 100 and the fitting 104 is quite acceptable. It will be seen that the coiled tubing string 100 may be run into the well 10 after the pump 22 and the coiled tubing string 24 have been run into the well because the fitting 104 will automatically latch into the latching recess 44 of the end cap 28.

The fitting 104 latches into the latching recess 44 of the end cap 28 and accordingly provides a series of split fingers 110 and cam faces 112. An O-ring seal 114 seals between the fitting 104 and the end cap 28. A central passage 116 extends through the fitting 104 and communicates with the mandrel passage 62.

On analysis, it will be seen that the only difference between the embodiments of FIGS. 1 and 2 relates to the path of the fluid used to return the piston 72 to its down or retracted position. In FIG. 1, the hydrostatic weight of the pumped formation fluid is used to retract the piston 72. In FIG. 2, the weight of a column of liquid in the annulus 102 pushes the piston 72 downwardly.

In operation of the embodiment of FIG. 2, any gas and liquid produced by the hydrocarbon formation separates in the well bore with the gas flowing up the annulus between the tubing string 12 and the casing 13. The pump 22 lifts formation liquids up the inside of the inner coiled tubing string 100 when tile piston 72 moves upwardly in the piston chamber 60 in response to high pressure liquid being pumped down the annulus 26 by the pump 92. When the piston 72 approaches the stop 96, steps are taken to retract the piston 72. In one mode of operation, the three way valve 94 simply connects the annulus 26 to the sump 98. The liquid selected for use in the annulus 102 is heavier than the pumped formation liquid and the hydrostatic weight of this column of liquid pushes down on the piston 72. It is quite easy to use field salt water in the annulus 102 which will normally be found to be considerably heavier than the pumped formation liquid which typically contains some hydrocarbons which lessen the density of the pumped formation liquids. In the alternative, the valve 94 may be a four-way valve which connects the annulus 26 to the sump 98 and which delivers pump pressure to the annulus 102.

It will accordingly be seen that upward or pumping movement of the piston 72 is caused by pump pressure applied downwardly through the annulus 26 and downward or retracting movement of the piston 72 is caused by the hydrostatic or pump pressure applied downwardly through the annulus 102. Those skilled in the art will recognize the production string 12 is typically 2⅜" OD or 2⅞" OD oilfield tubing run into the casing 13 with no packer to allow a gas flow path up the annulus between the casing 13 and tubing 12. The coiled tubing string 24 is typically 1½" OD and the coiled tubing string 100 is typically 1" O.D.

Figure 3:
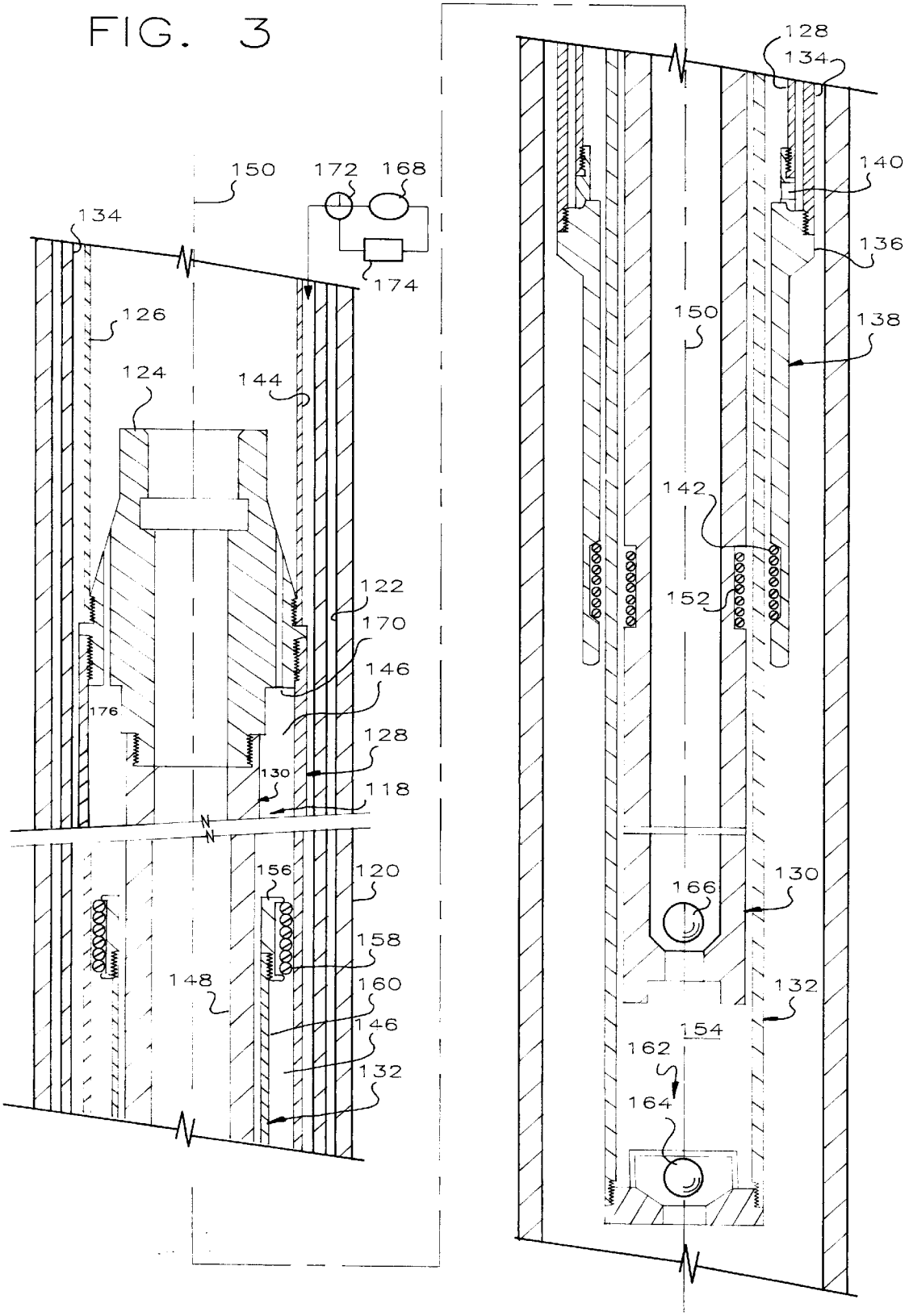
FIG. 3 is a view substantially identical to FIG. 2 except the well is a tubingless completion.

Referring to FIG. 3, there is illustrated a pump 118 inside a tubingless production string 120. Those skilled in the art will recognize the production string 120 as 2⅞" tubing cemented in the well bore. One problem with installing this invention in a tubingless production string is there is normally no seating nipple, analogous to the nipple 16, in a tubingless completion. Thus, the gas flow path is in the annulus 122 adjacent the production string 120 and some other provision is made to provide the flow paths to reciprocate the pump 118.

One technique that can be used to overcome this difficulty is shown in FIG. 3 where the pump 118 includes an upper assembly substantially identical to FIG. 1 and accordingly comprises, as major components, an end cap or fitting 124 providing connection to a coiled tubing string 126, a stationary outer barrel or housing 128, a stationary inner mandrel 130 and a reciprocating pump sleeve 132. The pump 118 differs from the embodiments of FIGS. 1 and 2 in providing a second coiled tubing string 134 extending from the surface and connecting, in any suitable manner, to a shoulder 136 provided by a sealing member or tailpiece 138. The tailpiece 138 connects to the stationary outer barrel 128, provides power ports 140 and provides a sealing assembly 142 engaging the pump sleeve 132. It will accordingly be seen that the tailpiece 138 provides a number of functions, some of which are analogous to that provided by the seating nipple 16 and some of which are provided by the sealing section 50 in the embodiments of FIGS. 1 and 2.

The barrel or housing 128 is essentially a long tube having its upper end threaded or otherwise connected to the end cap 124 and its lower end attached to the tailpiece 138. A power liquid pumped down the annulus 144 between the coiled tubing strings 126, 134 passes through the ports 140 into a piston chamber 146 to move the pump sleeve 132 upward in a pumping direction.

The mandrel 130 is threaded or otherwise attached to the end cap 124 and includes a central passage 148 coaxial with an axis 150 of the pump 118. The mandrel 130 also includes a plurality of seals 152 bearing against the interior of the reciprocating pump sleeve 132.

The pump sleeve 132 fits between the outer barrel 128 and the mandrel 130 in the piston chamber 146. A pump chamber 154 is provided between the pump sleeve 132 and the mandrel 130, below the seals 152. The pump sleeve 132 includes an annular piston 156 in the piston chamber 146 and having an assembly 158 sealing against the interior of the outer barrel 128, a tube 160 spaced from the mandrel 130 and a check valve assembly 162 allowing liquid entry into the bottom of the tube 160 and preventing downward or back flow from the tube 160.

The check valve assembly 162 is identical to that shown in the embodiments of FIGS. 1 and 2 and includes lower and upper ball checks 164, 166. When the pump sleeve 132 moves downwardly, the lower ball check 164 opens to allow formation fluids to enter the pump chamber 154. The upper ball check 166 is closed when the pump sleeve 132 moves downwardly because of the hydrostatic weight of the liquid above it. When the pump sleeve 132 mores upwardly, the lower ball check 164 closes and the upper ball check 166 opens, causing formation fluid to be lifted toward the surface of the well.

In operation of the embodiment of FIG. 3, any gas and liquid produced by the hydrocarbon formation separates in the well bore with the gas flowing up the annulus 122 between the outermost coiled tubing string 134 and the tubingless completion string 120. The pump 118 lifts formation liquids up the inside of the inner coiled tubing string 126 when the piston 156 moves upwardly in the piston chamber 146 in response to high pressure liquid being pumped down the annulus 144 by the pump 168. When the piston 156 approaches the stop 170, steps are taken to retract the piston 156. The three way valve 172 simply connects the annulus 144 to the sump 174. The liquid selected for use in the annulus 144 is lighter than the pumped formation liquid. The hydrostatic weight of the pumped formation liquid acts through the bypass ports 176 and pushes down on the piston 156.

It will accordingly be seen that upward or pumping movement of the piston 156 is caused by pump pressure applied downwardly through the annulus 144 and downward or retracting movement of the piston 156 is caused by the hydrostatic weight of pumped formation liquid.

Figure 4:
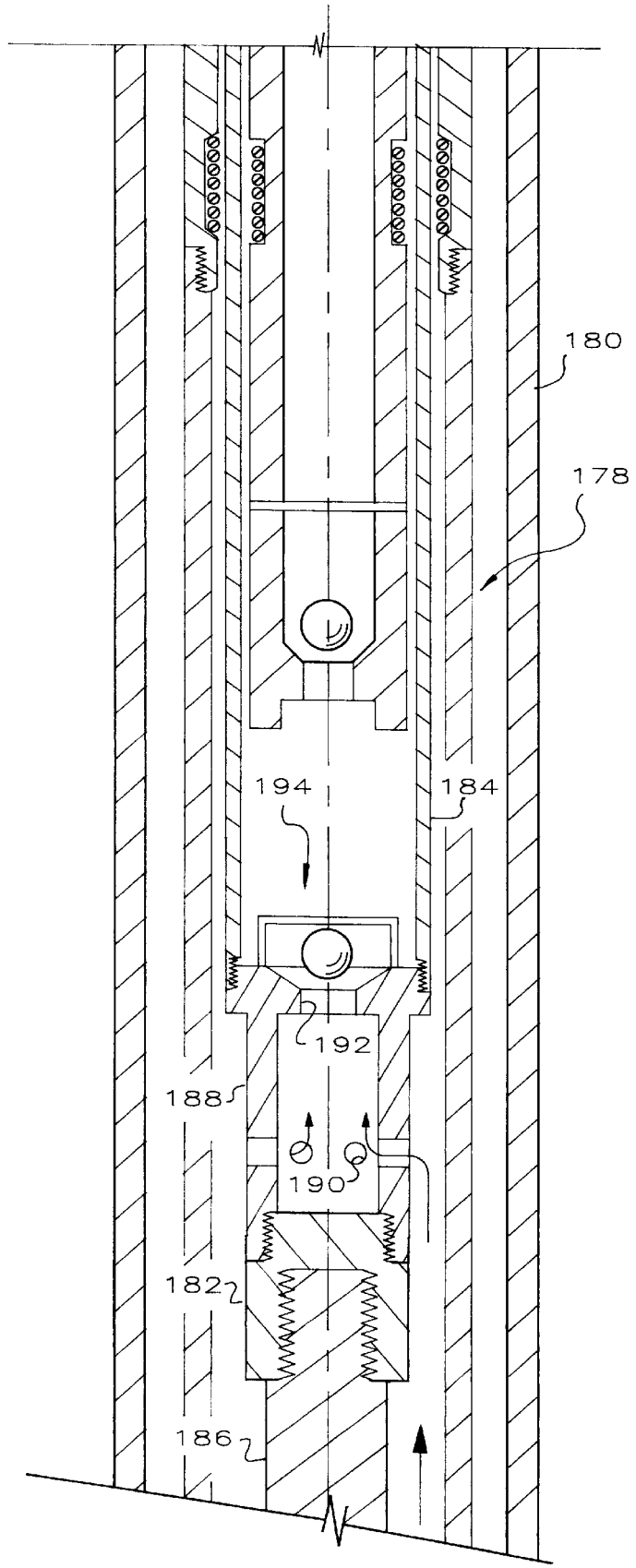
FIG. 4 is a longitudinal cross-sectional view of another version of this invention using the mechanism of this invention as a down hole motor to drive a conventional sucker rod pump.

Referring to FIG. 4, another pump 178 of this invention is illustrated. The pump 178 is used to pump liquids up a tubing string 180, which is typically run inside casing and set on a packer or gas anchor (not shown). The pump 178 is identical to the pump 118 of FIG. 3 except that a coupling 182 has been added to the bottom of the pump sleeve 184 to attach the reciprocating pump sleeve 184 to the upstanding rod 186 of a conventional downhole sucker rod pump. The coupling 182 includes a sleeve 188 attached to the bottom of the pump sleeve 184 and includes a series of openings 190 allowing entrance of pumped formation liquid into the inlet 192 of the pump 178. The sucker rod pump 186 is of conventional design and acts to pump liquid upwardly in response to reciprocation of the rod 186.

It will be seen that the pump 178 acts as a motor for reciprocating the input rod 186 and thereby operating the sucker rod pump 188. Thus, the check valve assembly 194, including the upper and lower ball checks 196, 198, may be eliminated thereby relying on the check valves (not shown) incorporated in the conventional sucker rod pump.

Operation of the pump 178 should now be apparent. Reciprocation of the pump sleeve 184 causes the input rod 186 to reciprocate thereby operating the downhole pump and pumping liquid up the inside of the pump 178.

Although this invention has been disclosed and described in its preferred forms with a certain degree of particularity, it is understood that the present disclosure of the preferred forms is only by way of example and that numerous changes in the details of construction and operation and in the combination and arrangement of parts may be resorted to without departing from the spirit and scope of the invention as hereinafter claimed.

I claim:

1. A hydrocarbon well extending from the surface of the earth to a subterranean formation comprising a production string extending from the surface to adjacent the formation;

a tubing string, extending from the surface to adjacent the formation, having an end and providing a first fluid path through the tubing string;

means providing a second fluid path from the surface to adjacent the end of the tubing string;

means for pumping formation liquids upwardly in the well in response to alternately increasing and then reducing pressure in a fluid path, including a fluid actuated reciprocating pump having a housing and a fluid transmitting fitting connecting the housing to the end of the tubing string and exchanging fluid between the first fluid path and the pump, a reciprocating pump piston in the housing having a first face exposed to pressure through one of the fluid paths and a second face exposed to pressure from an other of the fluid paths for pumping formation liquids up the one of the fluid paths in response to pressure being applied to the other of the fluid paths whereby formation fluids are pumped upwardly in the well by alternately increasing pressure in the other fluid path and then reducing pressure in the other fluid path.

2. The hydrocarbon well of claim 1 wherein the means providing the second fluid path from the surface to adjacent the end of the tubing string comprises an annulus between the production string and the tubing string.

3. The hydrocarbon well of claim 1 wherein the means providing the second fluid path from the surface to adjacent the end of the tubing string comprises a second tubing string.

4. The hydrocarbon well of claim 3 wherein the first mentioned tubing string is inside the second tubing string and the second fluid path is an annulus between the first and second tubing strings.

5. The hydrocarbon well of claim 1 wherein the formation fluids are pumped up the first fluid path in the tubing string.

6. The hydrocarbon well of claim 1 wherein the fitting supports the pump on the end of the tubing string.

7. The hydrocarbon well of claim 1 wherein the pump piston moves from a lowermost position providing a pump chamber of maximum capacity and an uppermost position providing a pump chamber of minimum capacity in response to pressure being applied through the other fluid path and means for moving the pump piston from the uppermost position to the lowermost position comprising hydrostatic weight of the formation fluids acting on the pump piston.

8. The hydrocarbon well of claim 1 further comprising a casing string cemented in the earth, the production string being inside the casing string and providing an annulus for delivering formation gas upwardly to the surface.

9. The hydrocarbon well of claim 8 further comprising a seating nipple in the production string, and wherein the fluid actuated reciprocating pump comprises seal means operative between the housing and the seating nipple for sealing therebetween, a pump sleeve connected to the piston, inside the housing and extending below the housing, seal means operative between the housing and the pump sleeve for sealing therebetween, a mandrel fixed to the fitting and inside the pump sleeve, seal means operative between the pump sleeve and the mandrel for sealing therebetween, and a check valve assembly including a lower check valve on the pump sleeve for preventing fluid flow when the pump sleeve is raised and an upper check valve assembly for preventing fluid flow when the pump sleeve is lowered.

10. The hydrocarbon well of claim 1 further comprising a sucker rod pump, below the reciprocating pump piston, having an upstanding rod and means connecting the pump piston to the rod of the sucker rod pump for reciprocating the sucker rod pump upon reciprocation of the pump piston.

11. The hydrocarbon well of claim 1 wherein the production string is cemented in the earth, and further comprising a second tubing string providing an annulus between the production string and the second tubing string for delivering formation gas upwardly to the surface.

12. The hydrocarbon well of claim 11 wherein the housing provides a second annulus with the second tubing string, and wherein the fluid actuated reciprocating pump comprises a pump sleeve connected to the piston, inside the housing and extending below the housing, seal means operative between the housing and the pump sleeve for sealing therebetween, a mandrel fixed to the fitting and inside the pump sleeve, seal means operative between the pump sleeve and the mandrel for sealing therebetween, and a check valve assembly including a lower check valve on the pump sleeve for preventing fluid flow when the pump sleeve is raised and an upper check valve assembly for preventing fluid flow when the pump sleeve is lowered.

13. The hydrocarbon well of claim 1 wherein the fluid actuated reciprocating pump comprises a pump sleeve connected to the piston, inside the housing and extending below the housing, seal means operative between the housing and the pump sleeve for sealing therebetween, a mandrel fixed to the fitting and inside the pump sleeve, seal means operative between the pump sleeve and the mandrel for sealing therebetween, and a check valve assembly including a lower check valve on the pump sleeve for preventing fluid flow when the pump sleeve is raised and an upper check valve assembly for preventing fluid flow when the pump sleeve is lowered.

14. The hydrocarbon well of claim 1 wherein the pump comprises a mandrel having a flow passage axially therethrough, a reciprocating pump sleeve around the mandrel having an annular piston around the mandrel, a barrel around the pump sleeve, first means sealing between the mandrel and the pump sleeve and second means sealing between the pump sleeve and the barrel.

15. The hydrocarbon well of claim 14 wherein the mandrel comprises a first check valve therein allowing upward liquid flow and preventing downward liquid flow and the pump sleeve comprises a second check valve below the first check valve allowing upward liquid flow and preventing downward liquid flow.

16. The hydrocarbon well of claim 14 wherein the first and second seal means reside in a horizontal plane.

17. The hydrocarbon well of claim 1 wherein the tubing string is a string of coiled tubing.

18. A method of operating a well having a production string extending from the surface to a hydrocarbon bearing subterranean formation, comprising supporting a fluid actuated pump adjacent one end of a string of tubing having a first fluid path therein, the pump including a reciprocable piston;

running the tubing string into the production string; providing a second fluid path from the surface to adjacent the end of the tubing string; and actuating the pump by delivering fluid pressure at the surface into one of the fluid paths and causing the reciprocable piston to move for pumping formation liquids up an other of the fluid paths.

19. The method of claim 18 wherein the one fluid path is an annulus between the production string and the tubing string and the other fluid path is the first fluid path inside the tubing string.

20. The method of claim 18 wherein the running step comprises sealing the tubing string against the production string thereby providing the second fluid path.

21. The method of claim 18 wherein the tubing string is a string of coiled tubing and the running step comprises running the coiled tubing string into the well.

* * * * *